United States Patent [19]

Piccini

[11] 4,123,053

[45] Oct. 31, 1978

[54] BATTING PRACTICE METHOD

[76] Inventor: Silvio D. Piccini, 13620 SW. 74th Ct., Miami, Fla. 33158

[21] Appl. No.: 800,419

[22] Filed: May 25, 1977

Related U.S. Application Data

[62] Division of Ser. No. 667,164, Mar. 15, 1976, Pat. No. 4,093,217.

[51] Int. Cl.[2] ..... A63B 69/40

[52] U.S. Cl. ..... 273/26 R; 272/78

[58] Field of Search ..... 273/26 R, 29 A; 272/76, 272/77, 78

[56] References Cited

U.S. PATENT DOCUMENTS

| | | | |
|---|---|---|---|
| 1,708,638 | 4/1929 | Smith | 273/55 A |
| 1,817,364 | 8/1931 | Goldsmith | 273/55 A |
| 2,586,283 | 2/1952 | Wynn | 273/55 A |
| 3,558,135 | 1/1971 | Rees | 273/55 A |

FOREIGN PATENT DOCUMENTS

| | | | |
|---|---|---|---|
| 516,092 | 12/1920 | France | 272/77 |

*Primary Examiner*—Richard C. Pinkham
*Assistant Examiner*—T. Brown
*Attorney, Agent, or Firm*—Jack E. Dominik

[57] ABSTRACT

Disclosed is a method of practicing batting including providing an open-ended cylinder formed of an elastomeric material and swinging the cylinder from a support above the cylinder by using at least three support members symmetrically spaced and attached atop the cylinder at one end and attached to the support on the other end. The method further includes repetitively swinging a bat against a strike area on the cylinder.

5 Claims, 5 Drawing Figures

BATTING PRACTICE METHOD

This is a division of application Ser. No. 667,167 filed Mar. 15, 1976 now U.S. Pat. No. 4,093,217.

FIELD OF INVENTION

The present invention relates to sporting goods support equipment, and more particularly a batting practice device. The relationship to a batter getting his practice is somewhat akin to that of a boxer and his punching bag. Relevant patent literature may be found in classes 9, subclass 8; class 46, subclass 87; class 114, subclass 219; class 272; subclasses 76, 77, 78, class 273, subclasses 55, 26, and 26(a).

SUMMARY OF THE PRIOR ART

Relevant patents appearing in the prior art include U.S. Pat. Nos. 291,015; 1,817,364; 3,558,135; 1,605,102; 2,826,416; 3,659,847; 1,708,638; 2,960,055; and British Pat. No. 518,988. In the main the subject patents relate either to punching bags or football blocking dummies. Invariably they are closed at both ends, and many contain an inflatable bladder. None of the subject devices noted in the prior art patents just recited is specifically designed for batting practice. Those which might be used for batting practice either have improper yieldable characteristics, they are not properly suspended to duplicate the impact of a bat hitting a ball, or they are not adapted for good weathering characteristics. A batting practice device is normally kept out-of-doors, and consequently is subjected to all of the elements. The principal means for batting practice, not shown in the prior art just recited, is an automobile tire or equivalent. They are usually suspended by means of a single rope tied around the periphery. The disadvantage of an automobile tire is that when it fills with water it is difficult to empty, and yet the water remaining in the tire will change the impact characteristics. Furthermore, the "strike zone" is a small arcuate portion of the periphery. Finally, a tire when suspended by a single cable or rope will rotate, and the batter during his practice may have to stabilize the tire each time after striking it, consequently not being able to maximize the number of blows which can be dealt to the tire in given period of time.

SUMMARY

The present invention contemplates a method utilizing a batting practice device in which the body portion is an open ended cylinder. The cylinder is formed of an elastomeric material, and supported by means of a sling secured to its upper portion at at least three points, and extending upwardly. Preferably the upper portion of the sling is conical is configuration, and terminates at a single point for subsequent suspension. Preferably the sling is made of a woven wire cable which will stabilize the unit quickly. The cylindrical body is desirably formed of a material having approximately a one-inch wall thickness, a diameter of approximately 10 inches (outside), and a height of at least 20 inches. Such a unit can weigh between 20 and 40 pounds; although varying dimensions, materials, weights, and wall thicknesses are contemplated.

In view of the foregoing, it is a principal object of the present invention to provide a method of batting practice which simulates the proper striking of a ball and permits the development of body muscles for time of impact as well as coordinating over the anticipated strike zone.

A related but also important object of the present invention is to provide a method of batting practice which permits repetitive training exercise during a minimum amount of practice time attributable to the rebound characteristics of the device.

Still another object of the present invention is to provide a method of batting practice which results in better conditioning of the necessary muscles of the arms and back for point of impact. Thus a greater distance can be achieved in hitting a free ball whether in the outfield or infield resulting from a more powerful swing.

Still another important object of the present invention is to provide a method of batting practice which will encourage a stronger grip on a bat which is necessary for better hitting. If a grip is not tight enough, the batting device will tend to knock the bat out of the hitter's hand. Therefore, the batter or hitter will consciously or subconsciously develop a tighter grip which is important to good batting.

Still another object of the present invention is to provide a method of batting practice which develops better follow-through of the batter's swinging motion necessary to better hitting. Good followthrough results from the cylindrical body from its elastomeric characteristics and the swinging motion of the sling.

Still another object of the present invention is to provide a method of batting practice which assists in developing stronger wrists in addition to the tighter grip.

Still another object is the development of the proper muscles of the legs, that being the repetitive use of this with stepping into the "pitch motion" and pivotal movement of the legs develops the same muscles for more powerful batting results.

Another and significant object of the present invention is to provide a method of batting practice which approximates the realistic height of a strike zone, thus developing a better swingthrough in the strike zone between its upper and lower limits.

Another object of the present invention is to provide a method of batting practice which psychologically develops the batter's confidence, which is a necessary ingredient of good hitting and when used by Little Leaguers or younger baseball players. It accustoms them to the shock of the bat contacting the ball and helps eliminates the fear or possible "sting" in the hands.

DESCRIPTION OF ILLUSTRATIVE DRAWINGS

Further objects and advantages of the present invention will become apparent as the following description proceeds, taken in conjunction with the accompanying illustrative drawings in which.

DESCRIPTION OF PREFERRED EMBODIMENT

Figure 1:
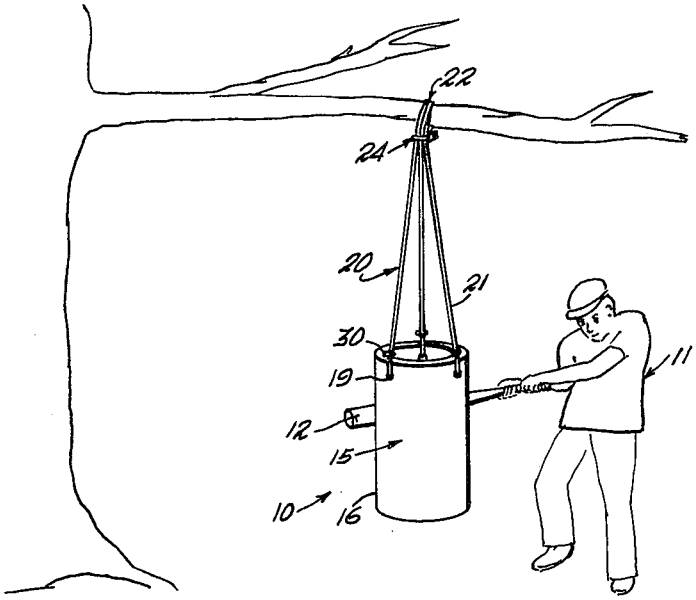
FIG. 1 is a perspective view of the batting practice device showing somewhat diagrammatically a baseball player practicing batting with the device.
Figure 2:
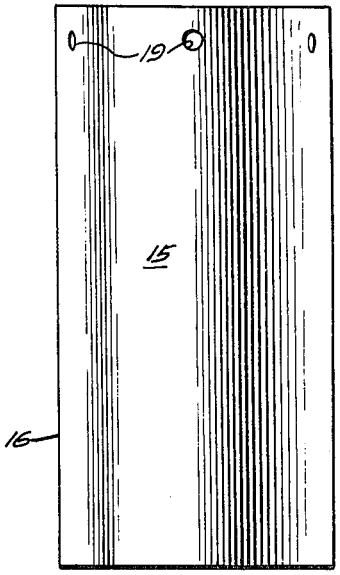
FIG. 2 is a foot elevation of the cylinder or cylindrical body of the batting practice device.
Figure 3:
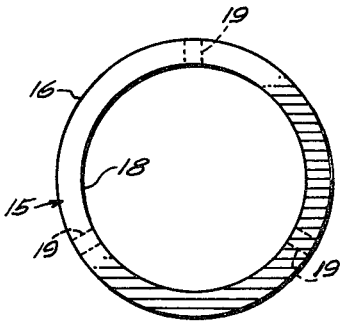
FIG. 3 is a top view of the cylindrical body of FIG. 2 taken in the same scale and showing in dotted lines the mounting holes for the sling.

The subject batting practice device 10, shown in FIG. 1, may be used by a batter 11, grasping the bat 12. The batter 11 swings the bat 12 to contact the cylindrical body 15 of the batting device 10. In one embodiment the height of the cylindrical body 15 is approximately 24 inches, and the diameter approximately 10½ inches, with an interior diameter of approximately 8½ inches. To be noted, particularly in FIGS. 2 and 3, is that the cylindrical body 15 is open ended at both the top and the bottom. This results in a more faithful duplication of the strike on a ball of the bat 12, because it is open-ended, rain and other contaminants pass through and the unit is virtually weatherproof except for whatever corrosion and weathering takes place with the support means and the material of the body of the cylinder 15.

As noted in FIG. 3, the cylindrical body 15 has an outer face 16, and an inner face 18. The outer face 16 is generally smooth, with the body of the cylinder being formed of several plys of rubber, usually overlying a fiber type material.

Figure 5:
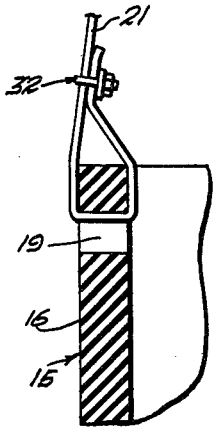
FIG. 5 is an enlarged, partially broken transverse view of the side mount of one of the support members of the sling to the cylindrical body.

The cylindrical body 15 of the batting practice device 10 is secured by means of a sling 20 to whatever available overhead support there may be. The sling 20 comprises a plurality of cables, ideally three, which are one-forth inch steel cables, preferably woven. The lower end of the cables 21, as noted in FIG. 5 are mounted in the mounting holes 19 in the side walls of the cylindrical body 15 at their upper portion. As shown in FIG. 5, a single piece of the cable 21 is passed downwardly and upwardly through the hole 19 to define a side mount eye, as an interior portion of the side mount 30. The cable 21 is doubled over on itself slightly, and secured in place by means of a side mount clamp or thimble 32.

Figure 4:
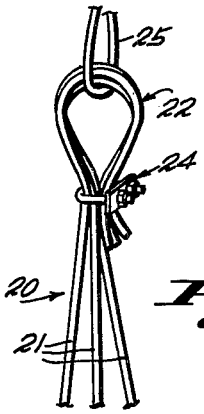
FIG. 4 is an enlarged partially broken view of the upper portion of the sling showing how the same is secured by means of a thimble of a clamping type U-bolt, and further tied to any support.

At the upper portion of the sling 20, a sling eye 22 (as shown in FIG. 4) is defined by doubling the cable over on itself so that in a three cable support, there will be 6 thicknesses of cable defining the upper sling eye 22, where the sling eye U-bolt clamp or thimble is applied to secure the same in place. Ideally, a nylon rope 25 passes through the sling eye 22, and secures the same to an overhead support such as the branch of a tree, a beam in a garage, or any other convenient overhead support which will accommodate the weight of the batting practice device 10.

In an ideal batting practice device 10, a rubber cylinder with duck plys, with the plys varying from 2 to 14, may be employed. The weight is approximately 38 pounds, but will vary depending upon whether the same is to be used by a child or an adult. The diameter can be as small as 6 inches, and extend outwardly to between 10 and 12 inches. The length varies between 20 and 24 inches. The ideal support, as pointed out above for the sling 20 comprises three steel cables of one-forth inch type. Four such cables can also be employed, but primarily achieves no major advantage and increases the cost. One or two cables may be used if connected to a webbing atop the cylinder, but again at some increased cost and little added advantage.

The cables are secure at the mounting holes 19 preferably by use of one inch thimbles, and a 1¾ inch thimble will secure the cables at the sling eye 22 at the upper portion of the cables 21.

Preferably the material for the cylindrical body 15 is abrasion resistant, both outside and inside. It should accommodate normal temperature extremes, and be open ended in order to pass water therethrough, as well as more faithfully duplicate the impact of a bat on a ball without the deflection being hampered by compressed air in the interior portion. The reinforcement plys should be closely woven duck with rubber layers. Commercial embodiments of dredging sleeves can be selected which will perform satisfactorily. It is desirable, however, that such sleeves not have a metallic mesh reinforcement interiorly of the construction unless spring steel or other resilient material is used, since the deflection may not result in a quick rebound to the original configuration. Important to the use of the subject device is a prompt rebound of the cylindrical wall 15, as well as a repositioning of the batting practice device 10 in its direct suspended relationship to the sling 20. In such a manner, the batter can accomplish more than 25 or 30 strikes per minute and consequently hundreds of swings or simulated hits during a 15 minute workout. In addition, a strike zone applied by circular bands for the high ball and low ball limits, permits the batter to concentrate his practice in the total strike zone. The device also readily accommodates the switch hitter.

Although particular embodiments of the invention have been shown and described in full here, there is no intention to thereby limit the invention to the details of such embodiments. On the contrary, the invention is to cover all modifications, alternatives, embodiments, usages and equivalents of a batting practice device as fall within the spirit and scope of the invention, specification and the appended claims.

What is claimed is:

1. A method of practicing batting including,
- providing an open ended cylinder formed of an elastomeric material,
- slinging the cylinder from a support above the cylinder by usng at least three support members symmetrically spaced and attached atop the cylinder at one end and attached to the support on the other end,
- repetitive swinging of a bat by a batter against a strike area on the cylinder.

2. A method as in claim 1,
- stabilising and orientating the cylinder by providing support members being woven of wire cables.

3. A method as in claim 1,
- reinforcing the cylinder with rubber like tube of at least two plys and weighing at least 10 pound per foot.

4. A method as in claim 1,
- providing the cylinder with a length of at least twice its diameter.

5. A method as in claim 1,
- forming the support members adjacent the top into a mounting eye, securing the eye to the support.

* * * * *